US006484864B2

(12) United States Patent
Sugata

(10) Patent No.: US 6,484,864 B2
(45) Date of Patent: Nov. 26, 2002

(54) COIN INSPECTION METHOD AND DEVICE

(75) Inventor: Masanori Sugata, Saitama (JP)

(73) Assignee: Kabushiki Kaisha Nippon Conlux (JP)

( * ) Notice: Subject to any disclaimer, the term of this patent is extended or adjusted under 35 U.S.C. 154(b) by 153 days.

(21) Appl. No.: 09/733,198

(22) Filed: Dec. 8, 2000

(65) Prior Publication Data

US 2001/0013458 A1 Aug. 16, 2001

(30) Foreign Application Priority Data

Dec. 9, 1999 (JP) ..... 11-350298

(51) Int. Cl.[7] ..... G07D 5/00; G07D 5/10; G07D 7/20

(52) U.S. Cl. ..... 194/317

(58) Field of Search ..... 194/302, 303, 194/317, 318, 319

(56) References Cited

U.S. PATENT DOCUMENTS 4,557,366 A * 12/1985 Yokomori et al. ..... 194/318
4,574,936 A * 3/1986 Klinger ..... 194/318
4,838,405 A * 6/1989 Kimoto ..... 194/318
4,936,435 A * 6/1990 Griner ..... 194/317
5,353,905 A * 10/1994 Yokomori ..... 194/317
5,871,075 A * 2/1999 Takayama ..... 194/318
6,325,197 B1 * 12/2001 Furuya ..... 194/318

FOREIGN PATENT DOCUMENTS

EP 0 384 374 A1 * 8/1990 ..... G07F/3/02

* cited by examiner

*Primary Examiner*—Donald P. Walsh
*Assistant Examiner*—Mark J Beauchaine
(74) *Attorney, Agent, or Firm*—Greer, Burns & Crain, Ltd.

(57) ABSTRACT

A coin inspection method and a device which can inspect a coin with a high precision, by extracting a large amount of information from a sensor detection signal waveform. In coin inspection which is performed based on a detection signal waveform of a magnetic sensor disposed along a coin pathway through which the coin passes, a differential waveform of the detection signal waveform is determined, first information indicating a peak position of the differential waveform, second information indicating a value of the detection signal waveform at the peak position of the differential waveform, and third information indicating a value of the differential waveform at the peak position of the differential waveform are extracted, and the extracted first through third information are used to inspect the coin.

22 Claims, 15 Drawing Sheets

—— DETECTION SIGNAL WAVEFORM

- - - DIFFERENTIAL WAVEFORM

—— DETECTION SIGNAL WAVEFORM

- - - DIFFERENTIAL WAVEFORM (a)

COIN INSPECTION METHOD AND DEVICE

BACKGROUND OF THE INVENTION

1. Field of the Invention

This invention concerns a coin inspection method and device for inspecting coin genuineness and denomination, and in particular, a coin inspection method and device appropriate for inspection of coins used in vending machines, game equipment and similar.

2. Description of the Related Art

In recent years, the coin inspection devices used in vending machines, game equipment and similar have primarily been electronic coin inspection devices using magnetic sensors which employ induction coils.

This type of coin inspection device generally utilizes the free-fall of the coin, and is configured such that a plurality of induction coils are positioned along the coin pathway guiding a coin which has been inserted from the coin insertion slot. Each of these induction coils is excited at a different frequency to form an electromagnetic field; by the passage through these electromagnetic fields of a coin inserted from the coin insertion slot, the change in the electromagnetic fields is employed to inspect the genuineness and the denomination of the coin.

Coin inspection by a coin inspection device using such magnetic sensors is based on widely-known principles; when a coin passes through the above electromagnetic fields, the amounts of electrical change (change in frequency, change in voltage, change in phase) resulting from the interaction between the electromagnetic fields and the coin are detected, and the genuineness and denomination of the coin are discriminated.

Previously, since coin characteristics are parameters which depend on frequencies; this type of coin inspection device is utilized as a technology which employs a plurality of frequencies to inspect the coin material, outside diameter, thickness and similar, as disclosed in U.S. Pat. No. 3,870,137.

In recent years, coin inspection devices have also been proposed which adopt techniques to detect the surface shape of coins; representative technology has been disclosed in Japanese Patent Laid-open No. H11-167655 and in Japanese Patent Laid-open No. H11-175793.

However, the internationalization of recent years has been accompanied by the easy import of coins from various countries, and there is an increasing number of cases in which such coins are erroneously inserted into vending machines and similar, or are inserted for the purpose of fraud by persons attempting illicit activities.

Among these coins from various countries, some resemble genuine coins in materials, outside diameter, thickness, and other parameters; and, are also rampant large quantities of coins which are coins from other countries, modified so as to resemble genuine coins.

Although such coins from other countries, or modified coins from other countries, have a surface design (pattern of protrusions) different from genuine coins, or have a different coin flange shape, there are nonetheless coins which essentially match in material, outside diameter, and thickness. Hence coin inspection devices using conventional magnetic sensors will sometimes erroneously accept such coins as genuine, and in this case unforeseen damages are incurred by the manager of the vending machine or similar.

Consequently, technology for the precise detection of the pattern of protrusions on the coin surface and the shape of the coin flange is sought.

However, because the coin inspection devices using conventional magnetic sensors are configured to discriminate the genuineness and denomination of the coin being inspected based solely on the peak values and peak positions of detection signal waveforms of magnetic sensors, the amount of information is small, and so there is the problem that coins of other countries, or modified coins of other countries, cannot be reliably discriminated.

SUMMARY OF THE INVENTION

An object of this invention is to provide a coin inspection method and device, enabling precise inspection of coins to be inspected, by extracting a large amount of information from sensor detection signal waveforms.

In order to achieve the above object, the invention of claim 1 is a coin inspection method, in which a sensor is positioned along a coin pathway through which a coin passes, and inspection of the coin is performed based on a detection signal waveform of the sensor, comprising the steps of: determining a differential waveform of the detection signal waveform; extracting first information indicating a peak position of the differential waveform, second information indicating a value of the detection signal waveform at the peak position of the differential waveform, and third information indicating a value of the differential waveform at the peak position of the differential waveform; and inspecting the coin by using the first through third information.

The invention of claim 2 is the invention according to claim 1, wherein an output of the sensor is sampled at fixed time intervals and converted from analog to digital values to obtain the detection signal waveform; and differences between adjacent digital values in the detection signal waveform are determined to obtain the differential waveform.

The invention of claim 3 is the invention according to claim 1, wherein when a value of the differential waveform at a time t is $\Delta(t)$, a time point at which a difference between the value $\Delta(t)$ and a value $\Delta(t-2)$ of the above differential waveform at a time $t-2$ which is two sample points previous is zero is extracted as the peak position of the differential waveform.

The invention of claim 4 is the invention according to claim 1, wherein when a value of the differential waveform at a time t is $\Delta(t)$, a time point at which a difference between the value $\Delta(t)$ and a value $\Delta(t-N)$ of the differential waveform at a time $t-N$ which is N sample points previous is zero is extracted as the peak position of the differential waveform.

The invention of claim 5 is a coin inspection method, in which a sensor is positioned along a coin pathway through which a coin passes, and inspection of the coin is performed based on a detection signal waveform of the sensor; comprising the steps of:

determining a differential waveform of the detection signal waveform; and inspecting the coin by using, as inspection information, a characteristic quantity of the differential waveform in a specific region.

The invention of claim 6 is the invention according to claim 5, wherein the specific region is a region corresponding to a flange part of the coin.

The invention of claim 7 is the invention according to claim 5, wherein an output of the sensor is sampled at fixed time intervals and a result is converted from analog into digital values to obtain the detection signal waveform, and differences between adjacent digital values of the detection signal waveform are determined to obtain the differential waveform.

The invention of claim 8 is the invention according to claim 5, wherein the specific region is a region including a zero-cross point-of the differential waveform.

The invention of claim 9 is the invention according to claim 8, wherein the characteristic quantity is a level difference between a height of valley part in the detection signal waveform in the specific region and a height of a peak part adjacent to the valley part in the detection signal waveform.

The invention of claim 10 is the invention according to claim 5, wherein the specific region includes a valley part of the differential waveform, and the characteristic quantity is a ratio of a height of valley part in the differential waveform to a height of a peak part adjacent to the valley part of the differential waveform.

The invention of claim 11 is the invention according to claim 5, wherein the specific region includes a valley part of the differential waveform, and the characteristic quantity is a value of the detection signal waveform corresponding to the valley part of the differential waveform.

The invention of claim 12 is a coin inspection device, in which a sensor is positioned along a coin pathway through which a coin passes and the coin is inspected based on a detection signal waveform of the sensor, comprising:

differential processing means for determining a differential waveform of the detection signal waveform;

information extraction means for extracting first information indicating a peak position of the differential waveform obtained by the differential processing means, second information indicating a value of the detection signal waveform at the peak position of the differential waveform, and third information indicating a value of the differential waveform at the peak position of the differential waveform; and, inspection means for inspecting the coin based on the first through third information.

The invention of claim 13 is the invention according to claim 12, wherein the differential processing means comprises:

analog-digital conversion means which samples the detection signal waveform of the sensor at fixed time intervals and converts a result from analog to digital values in order to determine detection data corresponding to the detection signal waveform; and differential data calculation means to determine differential data by calculating the differences between adjacent digital values of the detection data determined by the analog-digital conversion means, wherein the information extraction means extracts the first information indicating a peak position of the differential data determined by the differential data calculation means, the second information indicating a value of the detection data at the peak position, and the third information indicating a value of the differential data at the peak position; and the inspection means inspects the coin by using the first through third information extracted by the information extraction means.

The invention of claim 14 is the invention according to claim 13, wherein, when a value of the differential waveform at a time t is $\Delta(t)$, the information extraction means extracts, as the peak position of the differential waveform, a time point at which a difference between the value $\Delta(t)$ and a value $\Delta(t-2)$ of the differential waveform at a time t−2 which is two sample points previous is zero.

The invention of claim 15 is the invention according to claim 13, wherein, when a value of the differential waveform at a time t is $\Delta(t)$, the information extraction means extracts, as the peak position of the differential waveform, a time point at which a difference between the value $\Delta(t)$ and a value $\Delta(t-N)$ of the differential waveform at a time t−N which is N sample points previous is zero.

The invention of claim 16 is a coin inspection device in which a sensor is positioned along a coin pathway through which a coin passes, and the coin is inspected based on a detection signal waveform of the sensor, comprising:

differential processing means for determining a differential waveform of the detection signal waveform; and coin inspection means for inspecting the coin, using, as inspection information, a characteristic quantity in a specific region of the differential waveform determined by the differential processing means.

The invention of claim 17 is the invention according to claim 16, wherein the specific region is a region corresponding to a flange part of the coin.

The invention of claim 18 is the invention according to claim 16, 18. The coin inspection device according to claim 16, wherein the differential processing means comprises:

analog-digital conversion means which samples an output of the sensor at fixed time intervals and performs analog-digital conversion to obtain the detection signal waveform; and differential waveform calculation means which determines the differential waveform by calculating the differences between adjacent digital values in the detection signal waveform obtained by the analog-digital conversion means.

The invention of claim 19 is the invention according to claim 16, wherein the specific region is a region containing a zero-cross point of the differential waveform.

The invention of claim 20 is the invention according to claim 19, wherein the coin inspection means inspects the coin, using, as the inspection information, a level difference between a height of a valley part of the detection signal waveform corresponding to the specific region of the differential waveform, and a peak part adjacent to the valley part of the detection signal waveform.

The invention of claim 21 is the invention according to claim 16, wherein the specific region is a region including a valley part of the differential waveform, and the coin inspection means inspects the coin, using, as the inspection information, a ratio of a height of the valley part of the differential waveform to a height of a peak part of the differential waveform adjacent to the valley part.

The invention of claim 22 is the invention according to claim 16, wherein the specific region is a region including a valley part of the differential waveform, and the coin inspection means inspects the coin, using, as the inspection information, a value of the detection signal waveform corresponding to the valley part of the differential waveform.

According to this invention, changes in the output signal waveform of the sensor can be examined in detail by a simple method, whereby the characteristics of each coin can be detected precisely, and problems in coin selection can be prevented.

DESCRIPTION OF THE PREFERRED EMBODIMENTS

Below, aspects of the coin inspection method and device of this invention are explained in detail, referring to the attached drawings.

Figure 1:
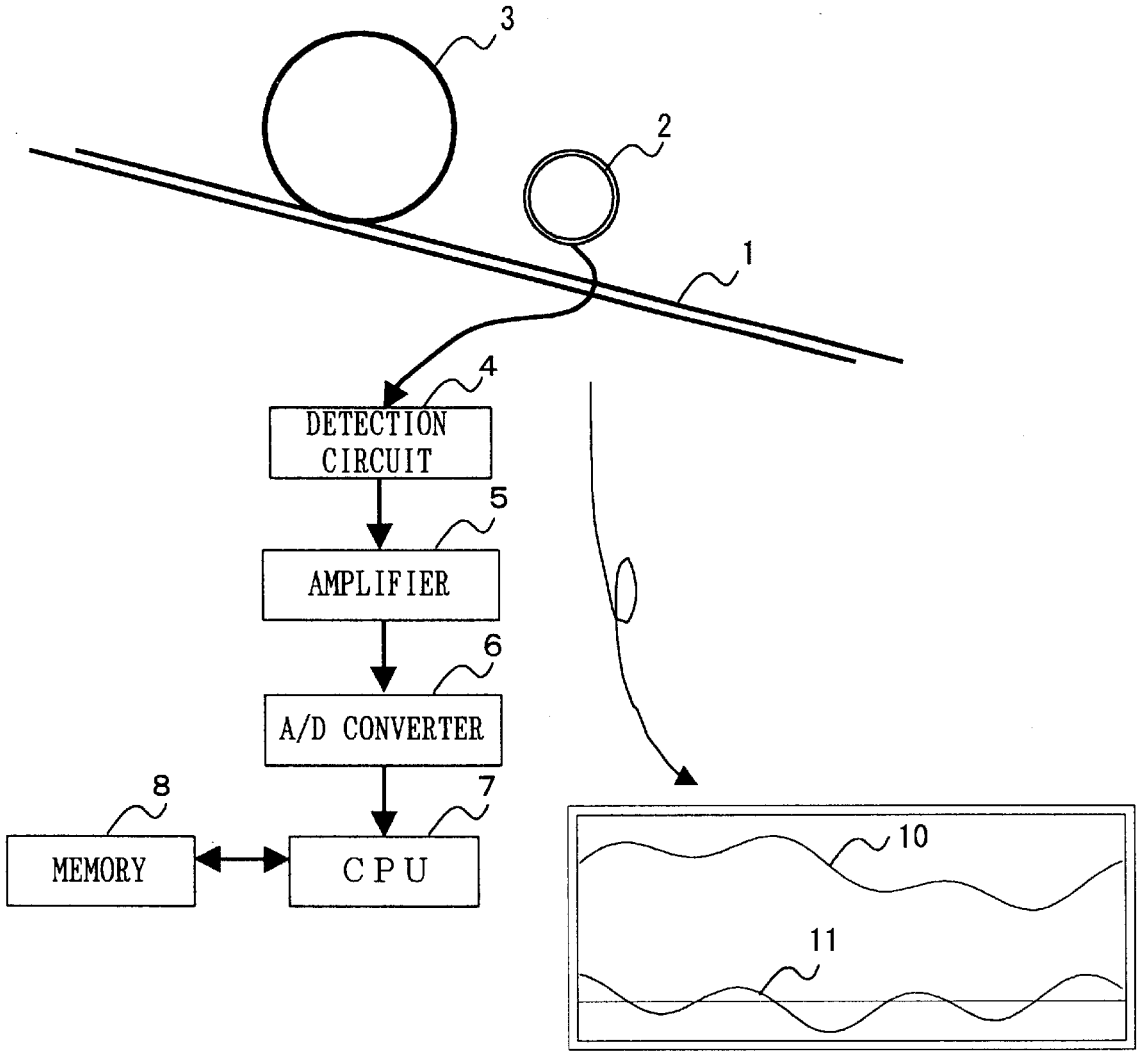
FIG. 1 is a block diagram showing schematically the configuration of a coin inspection device, configured to employ the coin inspection method and device of this invention.

FIG. 1 is a block diagram showing schematically the configuration of a coin inspection device, configured to employ the coin inspection method and device of this invention.

In FIG. 1, the coin inspection device of this aspect is configured such that the magnetic sensor 2 is positioned along the coin pathway 1, so that the genuineness and denomination of the coin 3 are inspected based on the detection signal waveform output from a magnetic sensor 2 when the coin 3, falling in rolling motion along the coin pathway 1, passes the magnetic sensor 2.

Here, as the magnetic sensor 2, 1) a magnetic sensor 2 comprising a coil, such that the coil inductance changes due to a coin when the coin passes in the vicinity of the coil; or,
2) a magnetic sensor 2 comprising coils, one of which is an oscillation coil, the other of which is a receiving coil, such that the mutual coupling factor (magnetic coupling coefficient) between the oscillation coil and receiving coil changes, or similar, can be used.

The detection signal waveform output from the magnetic sensor 2 is concentrated in a basic pattern representing the characteristics of the coin 3; the basic pattern data, which is set in advance, is compared with the basic pattern obtained for the inserted coin 3, to inspect the genuineness and denomination of the coin 3.

The detection signal (analog signal) output from the magnetic sensor 2 is first detected by a detection circuit 4, and after amplification by an amplifier 5, is sampled at a fixed time interval by an analog-digital converter (A/D converter) 6, and is converted into detection data comprising a plurality of digital data values corresponding to the detection signal output from the magnetic sensor 2.

This detection data is received by the central processing unit (CPU) and stored in memory 8.

The CPU 7 reads detection data stored in memory 8, determines differential data by taking the differences of the respective adjacent digital data, and stores this differential data in memory 8.

Here, if the waveform indicating detection data (detection signal waveform) corresponding to the detection signal output by the magnetic sensor 2 and input to the CPU 7 is similar to the detection signal waveform 10 shown in FIG. 1, then the waveform indicating differential data (differential waveform) determined by the CPU 7 is like the differential waveform 11.

The coin inspection device of this aspect is configured so as to inspect the genuineness and denomination of the coin 3, based on the waveform indicating detection data (detection signal waveform) 10 corresponding to the detection signal output from the above magnetic sensor 2, and the waveform indicating the above differential data (differential waveform) 11.

In other words, in the coin inspection device of this aspect, a magnetic sensor 2 is positioned along the coin pathway 1 through which a coin 3 passes, and in coin inspection to inspect the coin 3 based on the detection signal waveform 10 of the magnetic sensor 2, the differential waveform 11 of the detection signal 10 of the magnetic sensor 2 is determined; a first information, indicating the peak positions of the differential waveform 11, a second information, indicating the values of the detection signal waveform 10 at the peak positions of the differential waveform 11, and a third information, indicating the values of the differential waveform 11 at the peak positions of the differential waveform 11, are extracted; and, the above first through third information are used to inspect the coin 3.

Figure 2:
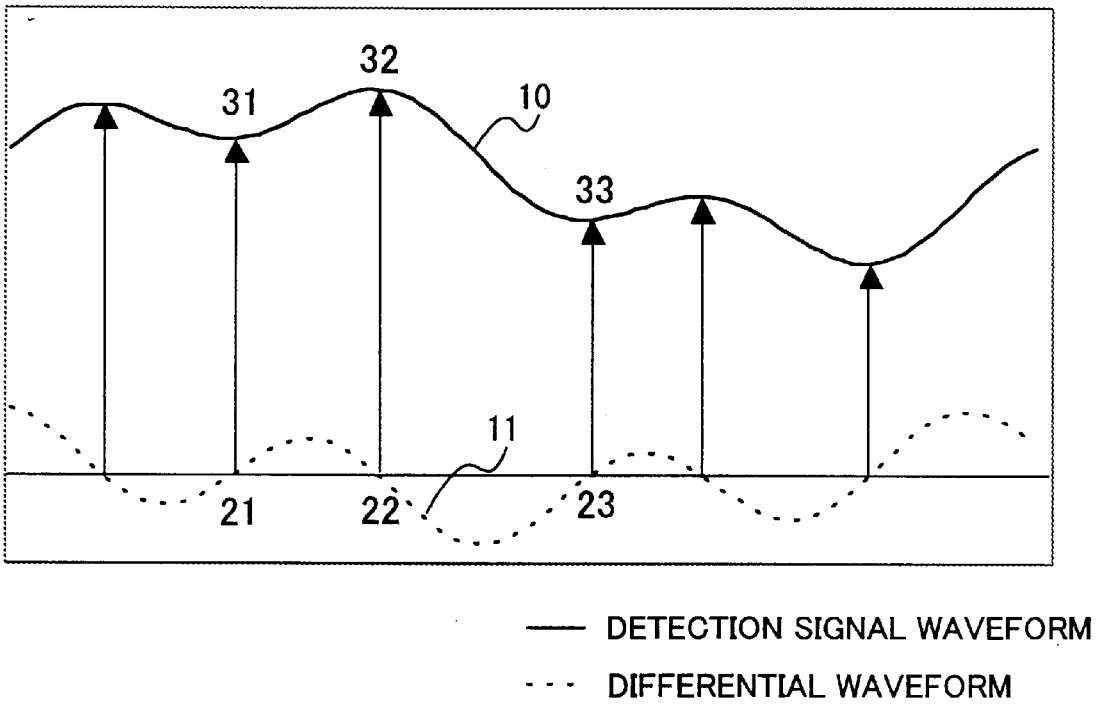
FIG. 2 is a diagram which focuses on peak values of the detection signal waveform 10 from the detection signal waveform 10 and differential waveform 11 shown in FIG. 1.

FIG. 2 is a diagram which focuses on the peak values of the detection signal waveform 10 from the detection signal waveform 10 and differential waveform 11 shown in FIG. 1.

As shown in FIG. 2, at points at which the differential waveform 11 is zero, for example points 21, 22, 23, the detection signal waveform 10 has peak values 31, 32, 33.

Hence by determining the points at which the differential waveform 11 is zero, the peak values of the detection signal waveform 10 can be determined.

Figure 3:
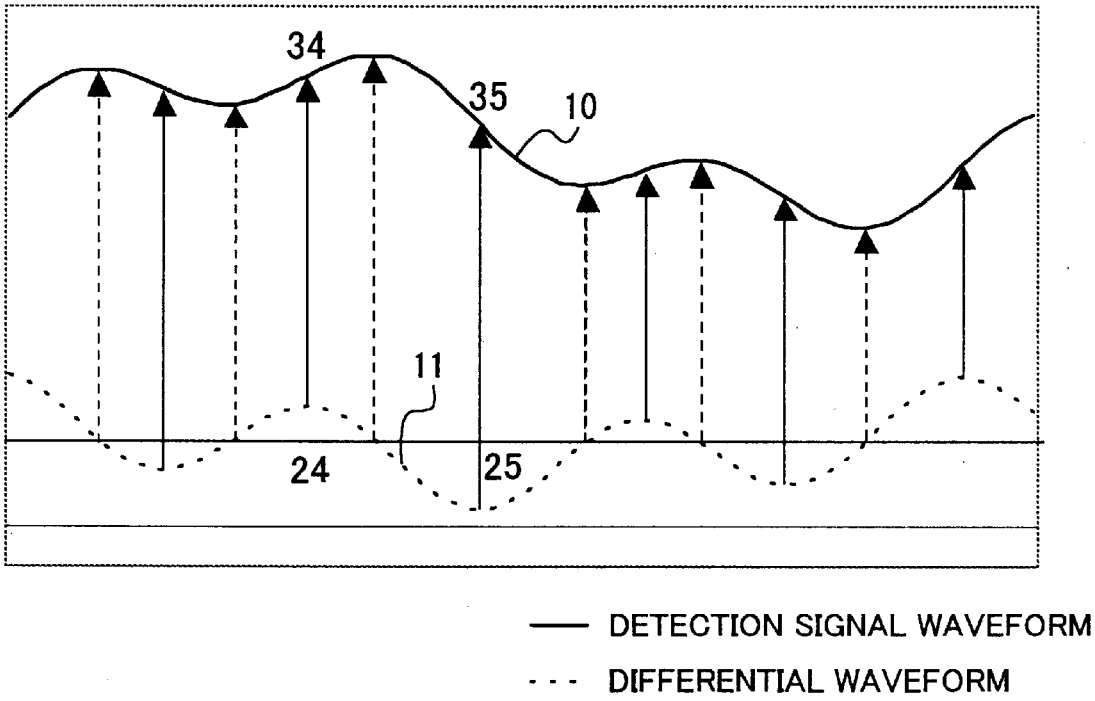
FIG. 3 is a diagram which focuses on fluctuations between peaks of the detection signal waveform 10 from peak values of the detection signal waveform 10 and differential waveform 11 shown in FIG. 1.

FIG. 3 is a diagram which focuses on fluctuations between peaks of the detection signal waveform 10 from the peak values of the detection signal waveform 10 and differential waveform 11 shown in FIG. 1.

As shown in FIG. 3, at points at which the differential waveform 11 shows a peak value, a state of fluctuation between peaks of the detection signal waveform 10 can be known.

For example, at point 24 indicating a peak value in the differential waveform 11, the detection signal waveform 10 changes in the increasing direction as at point 34, and at point 25 indicating a peak value in the differential waveform 11, the detection signal waveform 10 changes in the decreasing direction as at point 35.

Hence, as is clear from FIG. 3, by using the differential waveform 11 in addition to the detection signal waveform 10, a plurality of information related to the coin, including peak values and manners of fluctuation of the detection signal waveform 10, are obtained.

The speed of passage past the magnetic sensor 2 of coins 3, in rolling motion along the coin pathway 1, is not constant, and so when sampling at fixed intervals the detection signal of the magnetic sensor 2, the characteristics obtained at each sampling address are not necessarily the characteristics at the same locations of the coin.

However, peak values in the detection signal of the magnetic sensor 2 occur in relation to the characteristics of specific locations of the coin 3, so that by focusing on the peak values of the detection signal of the magnetic sensor 2, it is possible to always obtain the characteristics of the coin 3, regardless of the speed of passage of the coin 3 past the magnetic sensor 2.

Conventional coin inspection devices inspect the genuineness and denomination utilizing the values for the coin 3, focusing on the peak values of the detection signal waveform of the magnetic sensor 2.

However, when focusing on the peak values of the detection signal of the magnetic sensor 2, only part of the characteristics of the coin 3 are obtained; and skillfully fabricated counterfeit coins have appeared which make discrimination of genuine and counterfeit coins difficult.

Hence in the coin inspection device of this aspect of the invention, in addition to the waveform indicating the detection data (detection signal waveform) corresponding to the detection signal output from the magnetic sensor 2, by using a waveform indicating the differential data (differential waveform) 11, it is possible to inspect the genuineness and denomination of the coin 3 with high precision, without employing a complicated configuration in which other sensors are added.

Figure 4:
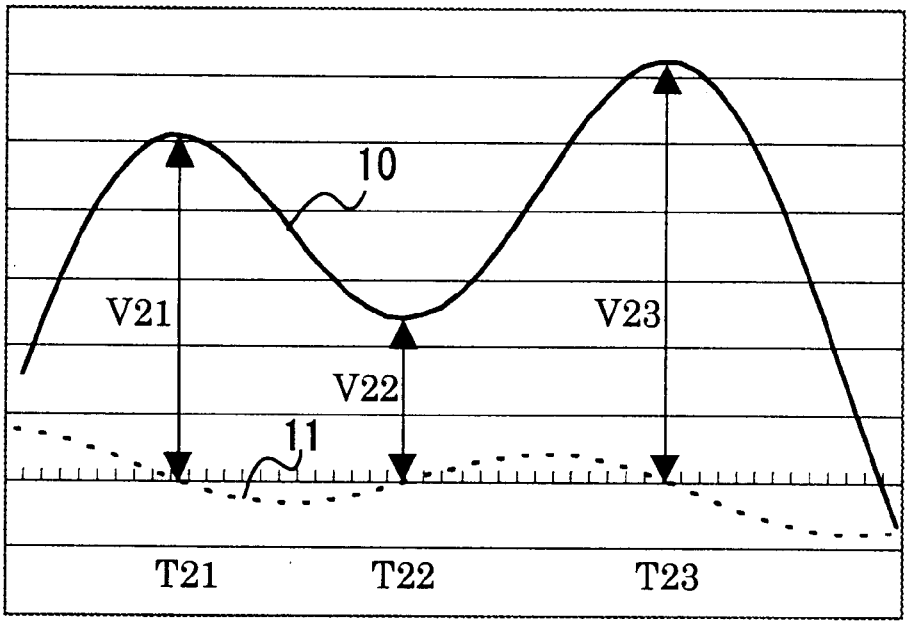
FIG. 4 is a diagram showing inspection information conventionally adopted by focusing on the peak values of the detection signal waveform 10 shown in FIG. 1.

FIG. 4 is a diagram showing inspection information conventionally adopted by focusing on the peak values of the detection signal waveform 10 shown in FIG. 1.

FIG. 4 shows the case of detection signal waveform 10 in which the waveform changes gradually between peaks, as in the case of a genuine coin. Here, as explained in FIG. 2, the detection signal waveform 10 exhibits peak values at points where the differential waveform 11 exhibits zeros.

Hence in the case of the detection signal waveform 10 shown in FIG. 4, the peak position T21 of the detection signal waveform 10 corresponding to the peak value V21 of the detection signal waveform 10, the peak position T22 of the detection signal waveform 10 corresponding to the peak value V22 of the detection signal waveform 10, and the peak position T23 of the detection signal waveform 10 corresponding to the peak position V23 of the detection signal waveform 10, for a total of six information V21, V22, V23, T21, T22, T23, can be adopted as inspection information for a coin 3 exhibiting this detection signal waveform 10.

Figure 5:
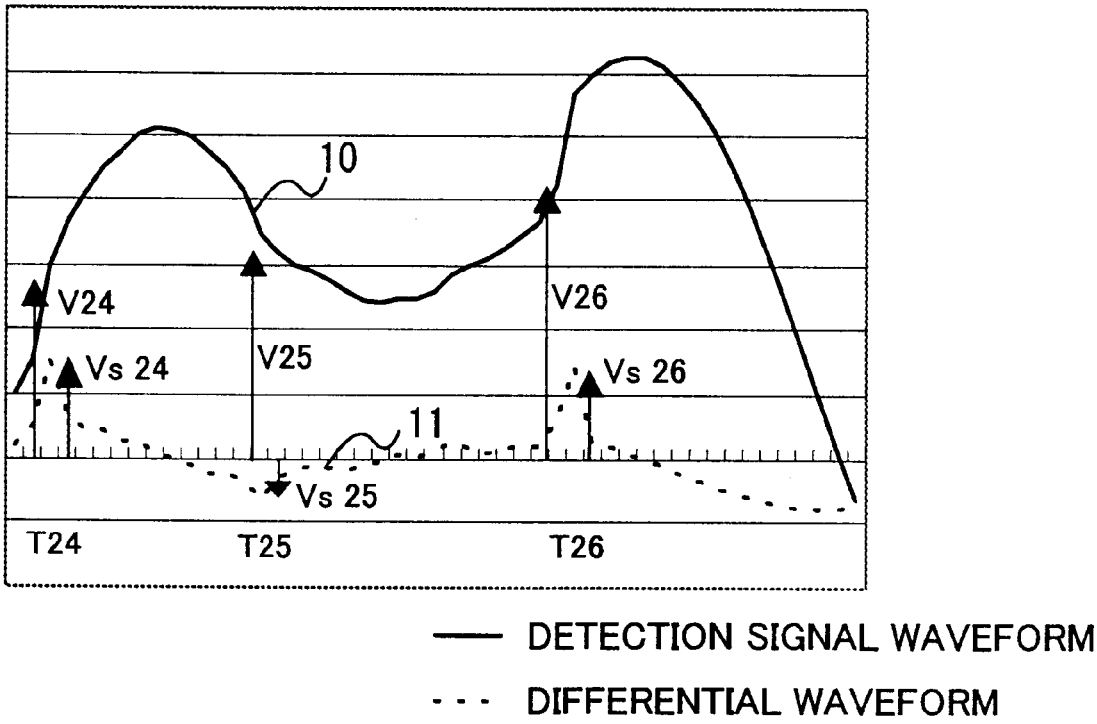
FIG. 5 is a diagram showing inspection information for this aspect of the invention, focusing on the detection signal waveform 10 and differential waveform 11 shown in FIG. 1.

FIG. 5 is a diagram showing inspection information for this aspect of the invention, focusing on the detection signal waveform 10 and differential signal 11 shown in FIG. 1.

The detection signal waveform 10 shown in FIG. 5 is a detection signal waveform corresponding to a coin, such as a modified coin from another country, in which there are rapid changes between peak values.

Here, in addition to the inspection information shown in FIG. 4, the value V24 of the detection signal waveform 10 and peak value Vs24 of the differential signal 11 corresponding to the peak position T24 of the differential signal 11, the value V25 of the detection signal waveform 10 and peak value Vs25 of the differential signal 11 corresponding to the peak position T25 of the differential signal 11, and the value V26 of the detection signal waveform 10 and peak value Vs26 of the differential signal 11 corresponding to the peak position T26 of the differential signal 11, are adopted as new inspection information.

By this means, in addition to the six inspection information shown in FIG. 4, V21, V22, V23, T21, T22, T23, it is possible to inspect coins 3 using the nine inspection information V24, V25, V26, Vs24, Vs25, Vs26, T24, T25, T26. As a result, it is possible to perform inspections of coins 3 based on 2.5 times the quantity of information used in the conventional method shown in FIG. 4, so that the detection precision of the genuineness and denomination of coins 3 can be greatly improved.

In general, if the number of peaks in the detection output waveform of the magnetic sensor 2 is N, then by the conventional method the number of inspection information obtained is $2\times N$, and in this invention it is $2\times N+3\times(N-1)=5\times N-3$. When there are a large number of peaks, the coin 3 can be inspected based on approximately 2.5 times the number of information, compared with the conventional method.

In this connection, the smoothness of changes between peaks in the detection output waveform 10 of the magnetic sensor can be evaluated from the peak values of the differential waveform 11, and the symmetry about peaks in the detection output waveform 10 of the magnetic sensor 2 can be evaluated from the relation between peak positions of the detection output waveform 10 of the magnetic sensor 2 and the peak positions of the differential waveform 11.

The coin inspection device of this invention is not limited to the above-described aspect; for example, similar application is possible in cases in which coin inspections are performed based on the combined waveform of a plurality of magnetic sensor outputs, as for example when using sensors in the coin inspection devices disclosed in Japanese Patent Laid-open No.H11-285666 or in Japanese Patent Laid-open No.H11-304066, applications previously submitted by this applicant.

In Japanese Patent Laid-open No.H11-285666 and in Japanese Patent Laid-open No.H11-304066, a detection signal waveform is obtained, using the combined outputs of two magnetic sensors, which is greatly affected by the coin flange part or by the surface pattern in particular.

Figure 6A:
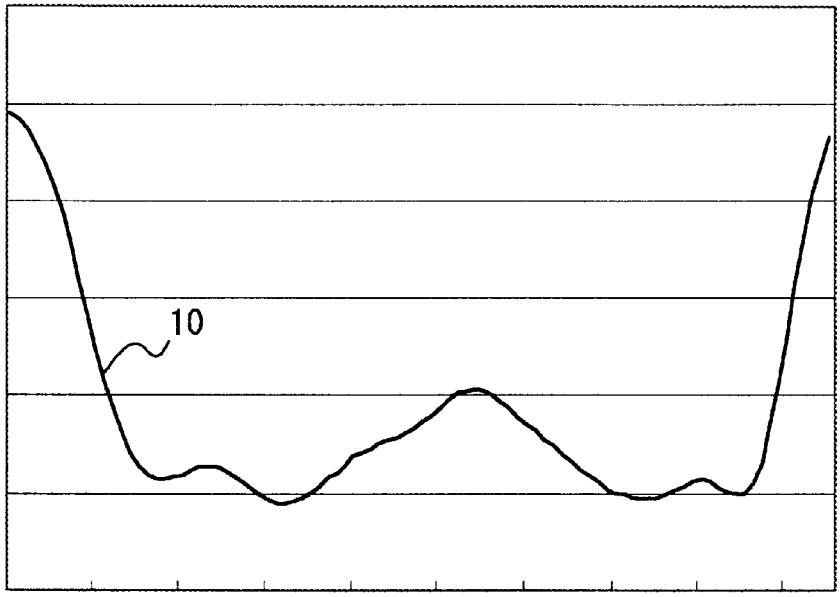
FIGS. 6(*a*) and 6(*b*) are diagrams showing detection output waveforms, emphasizing the effect of the coin flange part or surface pattern, obtained by using the combined output of two magnetic sensors.
Figure 6B:
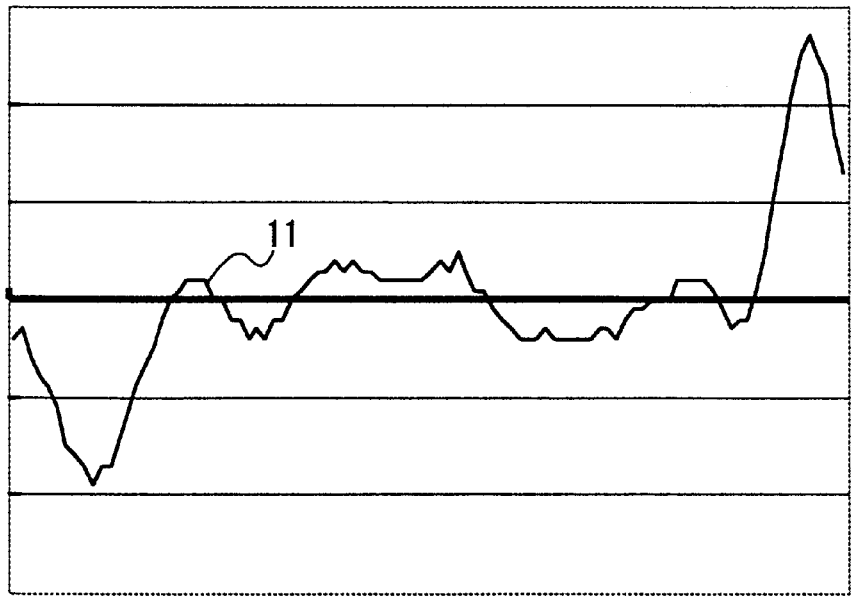

FIG. 6 is a diagram showing a detection output waveform, emphasizing the effect of the coin flange part or surface pattern, obtained by using the combined output of two magnetic sensors.

FIG. 6(*a*) shows the detection output waveform 10 for a 50-yen coin, sampled using an A/D converter having a 10-bit resolution; FIG. 6(*b*) is the differential waveform 10 for the detection output waveform 10 shown in FIG. 6(*a*).

As is clear from FIG. 6(*b*), in the differential waveform 11 shown in FIG. 6(*b*) the peaks are collapsed, and their positions are unclear.

The peak positions of the differential waveform 11 can be determined by further differentiating the differential waveform 11 to find the differential signal of the differential waveform, and determining the points at which this signal is zero.

Figure 7:
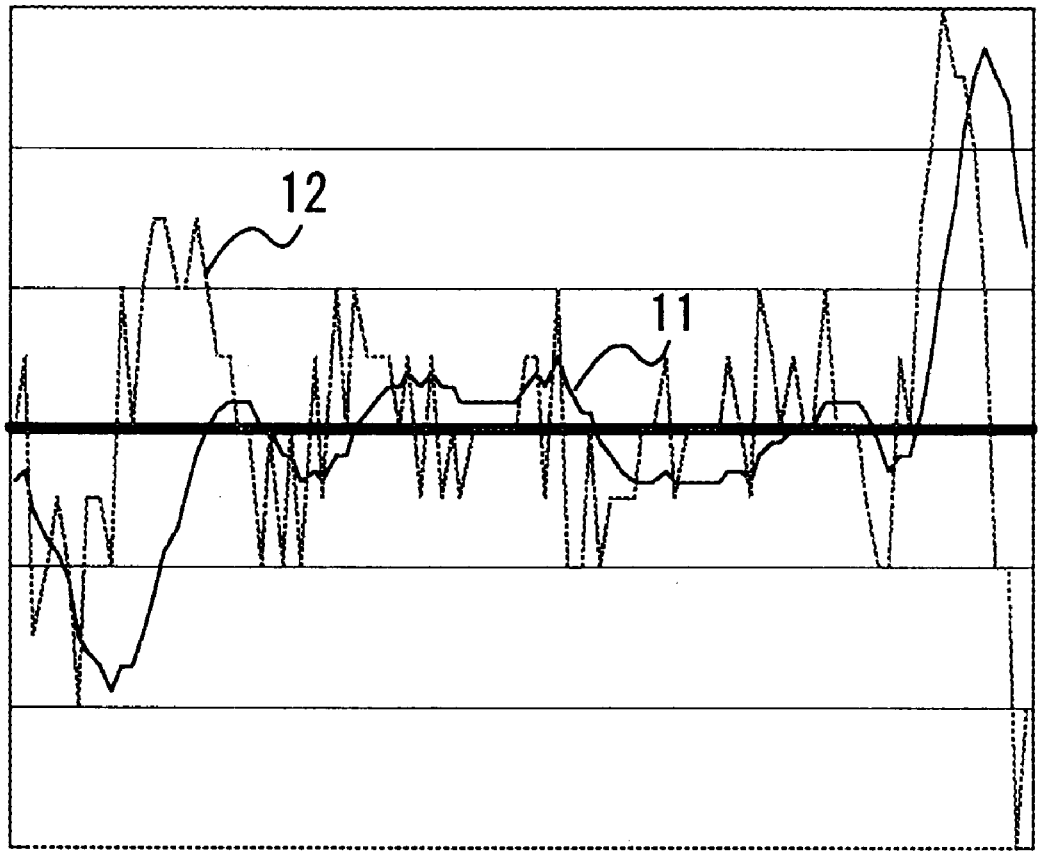
FIG. 7 is a diagram showing, superimposed on the differential waveform 11 shown in FIG. 6(*b*), a second-differential waveform 12, obtained by taking the differences of this differential waveform 11.

FIG. 7 is a diagram showing, superimposed on the differential waveform 11 shown in FIG. 6(*b*), a second-differential waveform 12, obtained by taking the differences of this differential waveform 11.

As is clear from FIG. 7, in the second-differential waveform 12 are seen numerous zero-cross points besides the peak positions of the differential waveform 11; consequently it is difficult to accurately perform peak detection for the differential waveform 11 using this second-differential waveform 12.

Figure 8:
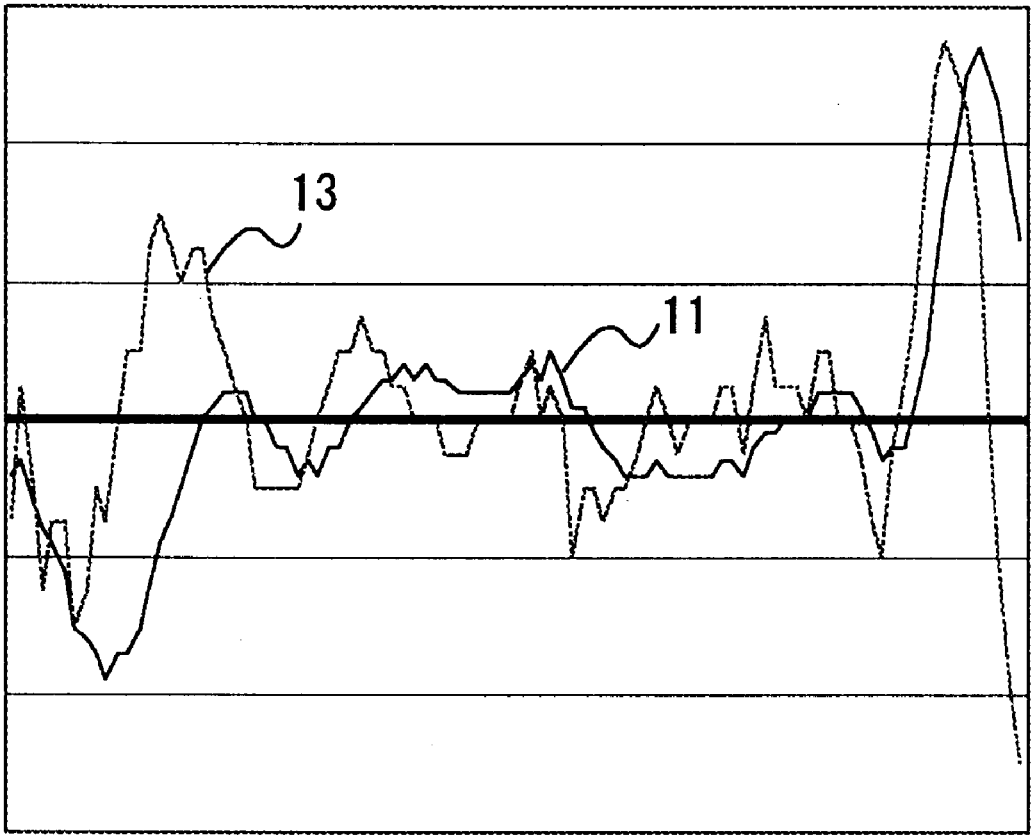
FIG. 8 is a diagram showing, superimposed on the differential waveform 11 shown in FIG. 6(*b*), a two-section moving-average waveform 13, obtained by taking the moving average among two sections of the second-differential waveform 12 shown in FIG. 7.

FIG. 8 is a diagram showing, superimposed on the differential waveform 11 shown in FIG. 6(*b*), a two-section moving-aver age waveform 13, obtained by taking the moving average among two sections of the second-differential waveform 12 shown in FIG. 7.

As is clear from FIG. 8, in the two-section moving-average waveform 13 shown in FIG. 8, the number of excess zero-cross points is reduced, and the precision of peak detection of the differential waveform 11 is improved.

If the values of the original detection output waveform 10 of the magnetic sensor 2 are C(t−4), C(t−3), C(t−2), C(t−1), C(t) . . . , and the values of the differential waveform are expressed as Δ(t)=C(t−1)−C(t), and the differential values are further expressed as Δ'(t)=Δ(t−1)−Δ(t), then on expressing Δ'(t) in terms of the data of the original detection output waveform 10 of the magnetic sensor 2, the following is obtained.

$$\Delta'(t)=C(t-2)-C(t-1)-(C(t-1)-C(t))=C(t2)-C(t-1)\times 2+C(t)$$

(formula for calculation of differential values of differences)

Here, the two-section moving average of the differential values of differences is $$(\Delta'(t-1)+\Delta'(t))/2$$

(formula defining two-section moving average)

Hence twice this value can be expressed by the following simple formula.

$$\Delta'(t-1)+\Delta'(t)=C(t-3)-C(t-2)\times 2+C(t-1)+C(t-2)-C(t-1)\times 2+C(t)=(C(t-3)-C(t-2))-(C(t-1)-C(t))=\Delta(t-2)-\Delta(t)$$

Hence in order to search for zero-cross points in the two-section moving-average waveform 13, it is sufficient to search for points at which $$\Delta(t-2)-\Delta(t)=0$$

obtains.

In this aspect of the invention, the two-section moving-average waveform 13 is adopted in order to determine the peak values of the differential waveform 11, and as a method for searching for zero-cross points in this two-section moving-average waveform 13, points for which the condition $$\Delta(t-2)-\Delta(t)=0$$

obtains are sought.

Compared with the zero-cross point condition determined from the formula defining the two-section moving average, $$\Delta'(t-1)+\Delta'(t)=0,$$

this condition requires less calculation, to the extent that there is no need to calculate the difference of a difference, and enables easy detection of the peak values of the differential waveform 11 even when the differential waveform 11 is complex.

The above aspect has been explained with respect to a two-section moving average of the difference values of differences; but when the number of sections is three or more, zero-cross points of the difference values of differences can similarly be found using only two difference values.

For example, the condition for zero-cross points in the case of three sections is, taking three times the three-section moving average values using the above-described calculation formula, modified to $$\Delta'(t-2)+\Delta'(t-1)+\Delta'(t)=\Delta(t-3)-\Delta(t)$$

so that $$\Delta(t-3)-\Delta(t)=0$$

In general, for an N-section moving average, Δ(t−N)−Δ(t)=0.

Thus by adopting this technique, a simple method can be used to precisely capture slight changes in magnetic field, the characteristics of various types of coins can be precisely detected, and high-precision coin selection can be achieved.

The above aspect is configured so as to inspect the genuineness and denomination of coins based on the detection signal waveform 10 of the magnetic sensor 2 and its differential waveform; when discriminating the genuineness of modified coins from other countries and similar, a method which discriminates genuineness based on characteristic quantities of a specific region of the counterfeit coin is effective.

For example, in Japanese Patent Laid-open No.H11-285666, previously submitted by the applicant of this application, by improving the magnetic sensor, a detection signal waveform is obtained with the characteristics of the coin flange part emphasized, enabling discrimination of the genuineness of counterfeit coins which are modifications of coins from other countries and similar.

Figure 9:
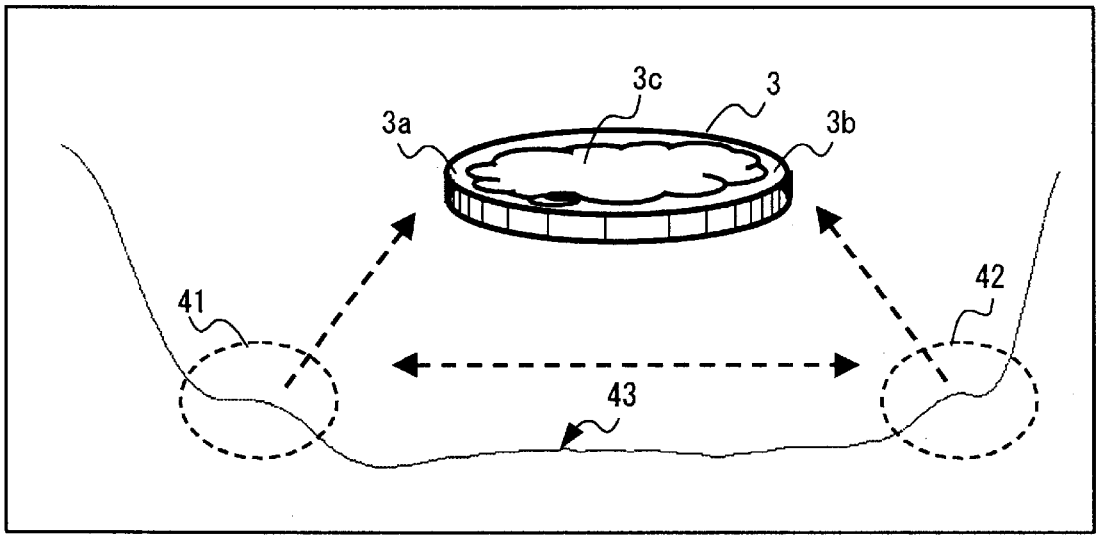
FIG. 9 is a waveform diagram showing one example of a detection signal waveform with the characteristics of the coin flange part emphasized.

FIG. 9 is a waveform diagram showing one example of a detection signal waveform with the characteristics of the coin flange part emphasized.

The detection signal waveform 10 shown in FIG. 9 has, in the region corresponding to the coin flange parts 3*a*, 3*b*, a first inflection point 41 and a second inflection point 42; the shapes of this first inflection point 41 and second inflection point 42 correspond to the shapes of the coin flange parts 3*a*, 3*b*.

Further, the region 43 between this first inflection point 41 and second inflection point 42 corresponds to the pattern of protrusions on the surface 3*c* of the coin 3.

In this aspect of the invention, the genuineness of the coin 3 is discriminated by focusing on the first inflection point 41 and second inflection point 42 of the detection signal waveform 10 corresponding to the flange parts 3*a,* 3*b* of the coin 3.

Figure 10A:
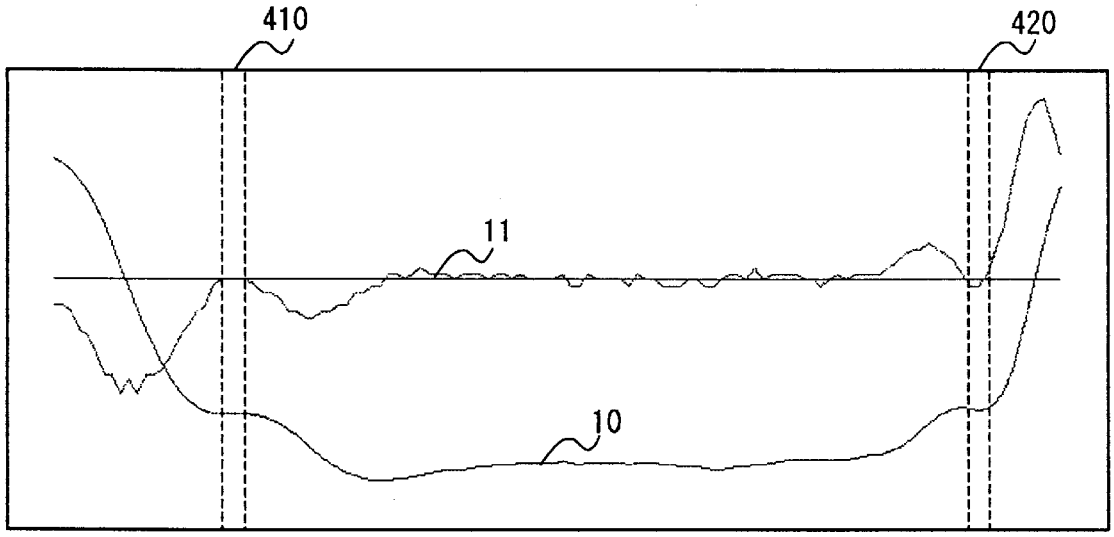
FIGS. 10(*a*) to 10(*c*) are diagrams explaining a first method for discriminating the genuineness of a coin 3, focusing on the first inflection point 41 and second inflection point 42 of the detection signal waveform shown in FIG. 9.
Figure 10B:
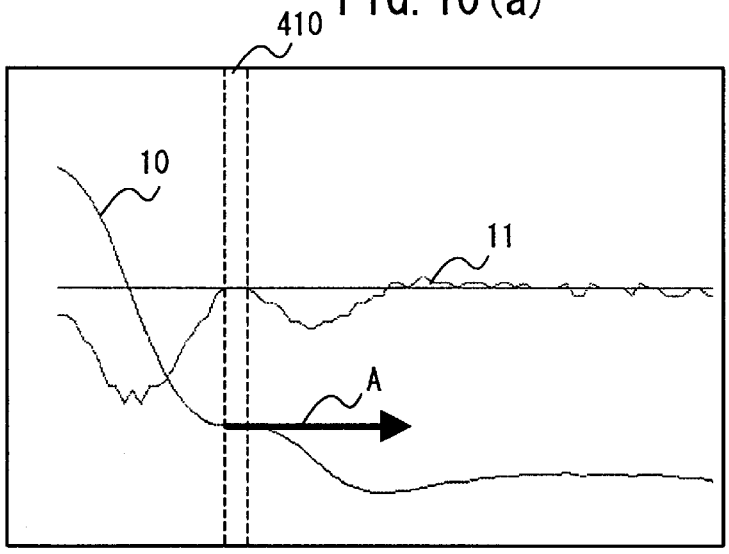
Figure 10C:
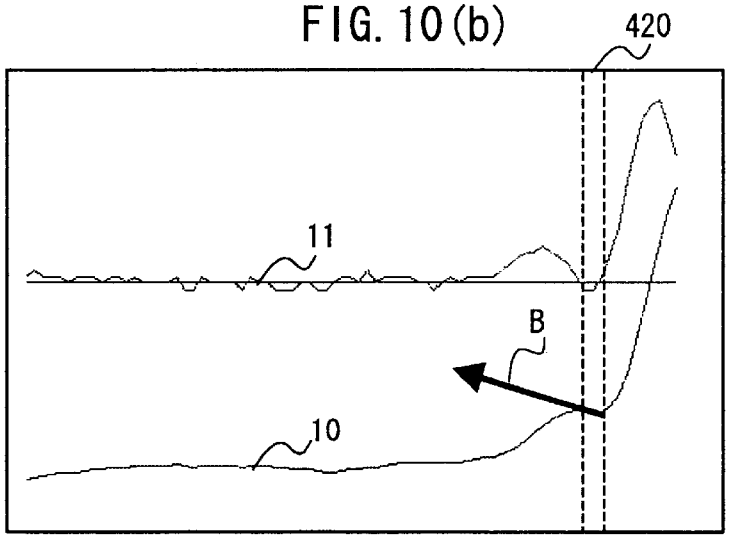

FIG. 10 is a diagram which explains a first method for discriminating the genuineness of a coin 3, focusing on the first inflection point 41 and second inflection point 42 of the detection signal waveform shown in FIG. 9.

In FIG. 10, FIG. 10(*a*) shows superimposed the detection signal waveform 10 and the differential waveform 11 of this detection signal waveform 10, corresponding, for example, to a 500 yen coin.

In FIG. 10(*a*), the regions 410 and 420 are regions corresponding to the flange parts 3*a* and 3*b* of the coin (regions corresponding to the first inflection point 41 and second inflection point 42), and the differential waveform 11 crosses the zero-level in these regions 410 and 420.

Focusing on the differential waveform 11 in the region 410 corresponding to the first inflection point 41, the direction of the slope of the detection signal waveform 10 in this region 410 is approximately horizontal, as shown by the arrow A in FIG. 10(*b*).

Focusing on the differential waveform 11 in the region 420 corresponding to the second inflection point 42, the direction of the slope of the detection signal waveform 10 in this region 420 is approximately upward, as shown by the arrow B in FIG. 10(*c*).

Figure 11A:
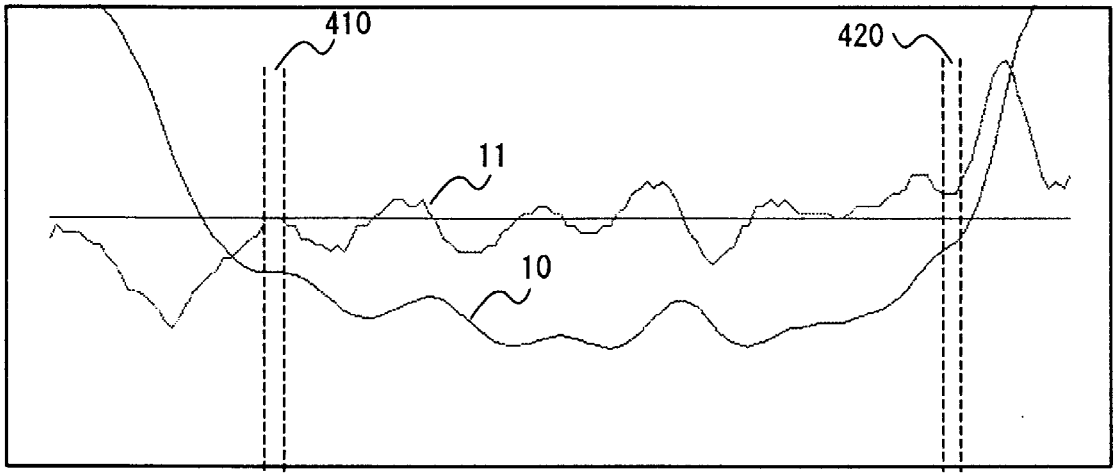
FIGS. 11(*a*) to 11(*c*) are diagrams showing one example of a counterfeit coin detection signal waveform and its differential waveform corresponding to the genuine coin detection signal waveform and its differential waveform shown in FIGS. 10(*a*) to 10(*c*)
Figure 11B:
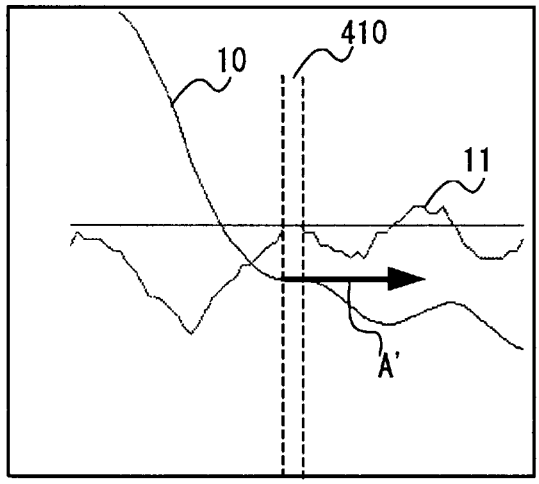
Figure 11C:
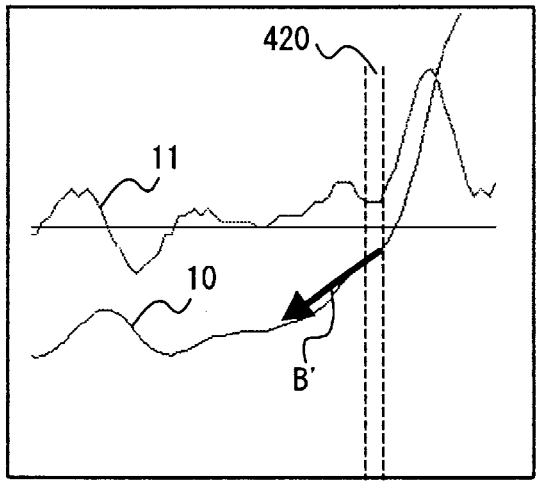

FIG. 11 is a diagram showing one example of a counterfeit coin detection signal waveform and its differential waveform corresponding to the genuine coin detection signal waveform and its differential waveform shown in FIG. 10.

In FIG. 11, the region 410 and the region 420 are regions corresponding to the flange parts 3*a* and 3*b* of the coin 3 (the regions corresponding to the first inflection point 41 and second inflection point 42), and the differential waveform crosses the zero-level in the region 410 and the region 420.

Focusing on the differential waveform 11 in the region 410 corresponding to the first inflection point 41, the direction of the slope of the detection signal waveform 10 in this region 410 is approximately horizontal, as shown by the arrow A', similarly to that shown by the arrow A in FIG. 10(*b*).

However, focusing on the differential waveform 11 in the region 420 corresponding to the second inflection point 42, the direction of the slope of the detection signal waveform 10 in this region 420 is downward as shown by the arrow B', differing from the direction indicated by the arrow B in FIG. 10(*c*).

Thus genuine coins and counterfeit coins can be discriminated through the difference in the direction of the slope of the detection signal waveform 10 in the region 420 corresponding to the second inflection point 42.

The direction of the slope of the detection signal waveform 10 in the region 420 corresponding to the second inflection point 42 changes with the speed of passage past the magnetic sensor of the coin 3, falling in rolling motion along the coin pathway 2.

Figure 12A:
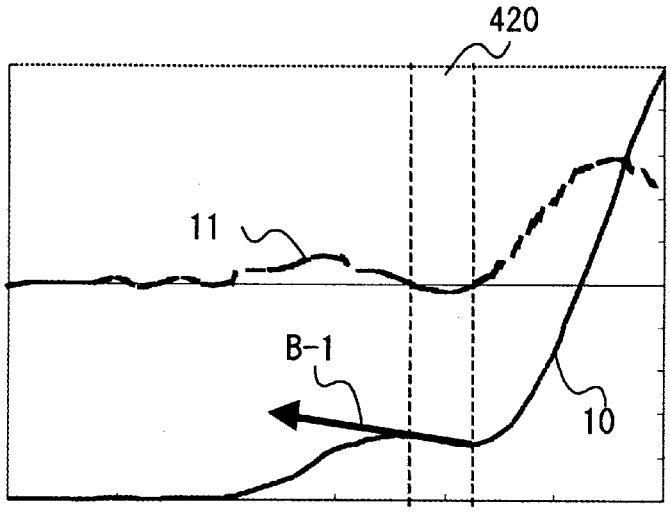
FIGS. 12(*a*) to 12(*c*) are diagrams showing the direction of the slope of the detection signal waveform 10 in the region 420 corresponding to the second inflection point 42 of the detection signal waveform shown in FIG. 9, corresponding to the speed of passage of the coin 3 past the magnetic sensor 2.
Figure 12B:
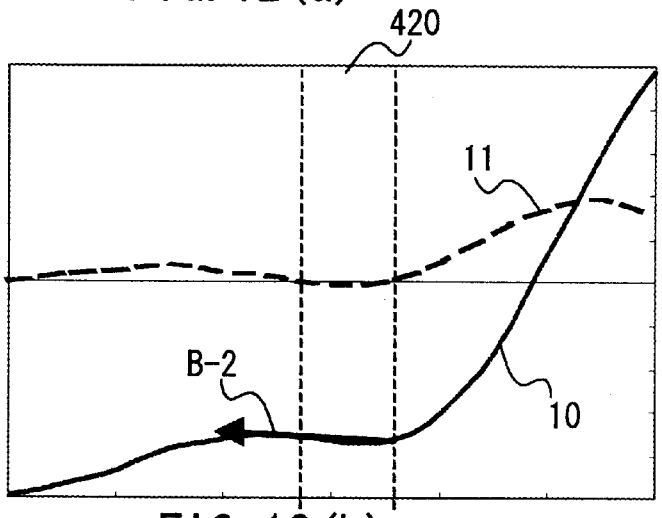
Figure 12C:
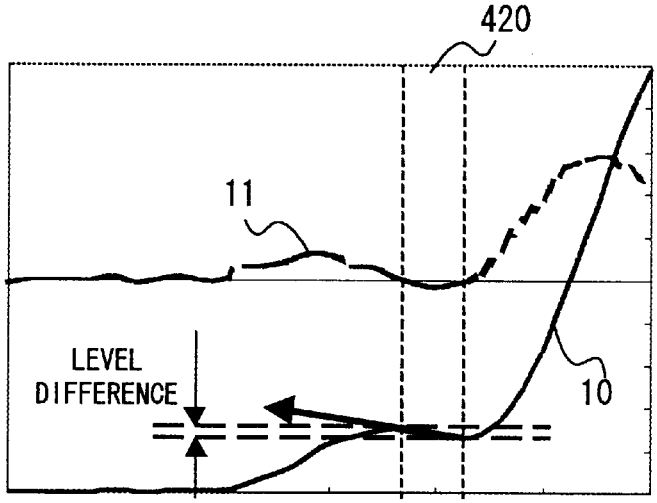

FIG. 12 shows the direction of the slope of the detection signal waveform 10 in the region 420 corresponding to the second inflection point 42 of the detection signal waveform shown in FIG. 9, corresponding to the speed of passage of the coin 3 past the magnetic sensor 2.

In FIG. 12, FIG. 12(*a*) shows the case in which the speed of passage of the coin 3 relative to the magnetic sensor 2 is fast, and FIG. 12(*b*) shows the case in which the speed of passage of the coin 3 relative to the magnetic sensor 2 is slow.

As is clear from FIG. 12(*a*) and FIG. 12(*b*), when the speed of passage of the coin 3 with respect to the magnetic sensor 2 is slow, compared with the case in which the speed of passage of the coin 3 with respect to the magnetic sensor 2 is fast, the direction of the slope of the detection signal waveform 10 changes to the horizontal direction, from the direction indicated by the arrow B-1 in FIG. 12(*a*) to the direction indicated by the arrow B-2 in FIG. 12(*b*).

However, as shown in FIG. 12(*c*), in terms of the interval of the region 420 corresponding to the second inflection point 42, differences in the level of the detection signal waveform 10 are constant and independent of the speed of passage of the coin 3 with respect to the magnetic sensor 2.

Hence in the case that the first method is adopted, if level differences in the interval of the region 420 corresponding to the second inflection point 42 are taken as inspection information, it is possible to reliably discriminate the genuineness of the coin 3 independently of the speed of passage of the coin 3 with respect to the magnetic sensor 2.

Figure 13:
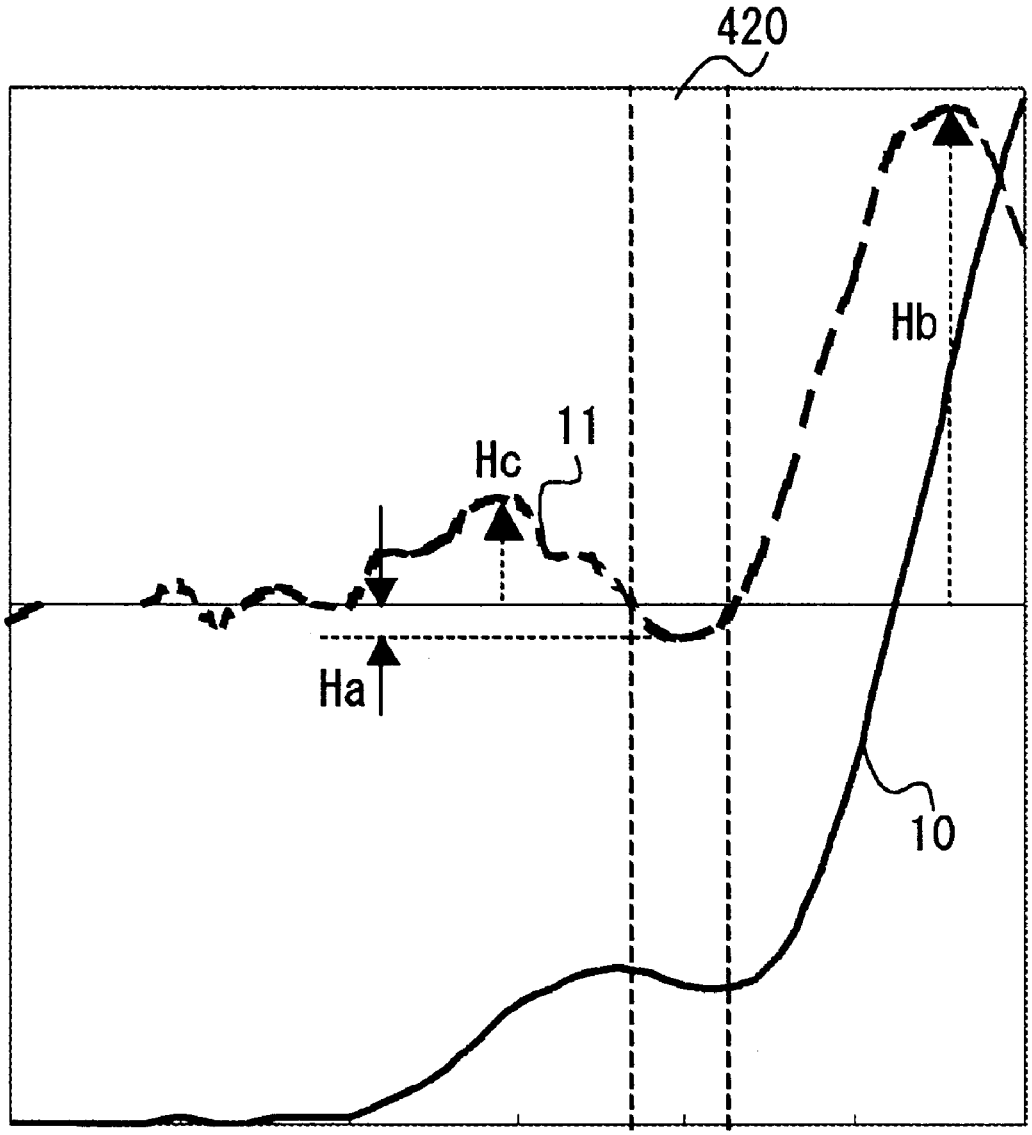
FIG. 13 is a diagram which explains a second method for discriminating the genuineness of the coin 3, focusing on the region 420 corresponding to the second inflection point 42 of the detection signal waveform shown in FIG. 9.

FIG. 13 is a diagram which explains a second method for discriminating the genuineness of a coin 3, focusing on the region 420 corresponding to the second inflection point 42 of the detection signal waveform shown in FIG. 9.

In the second method shown in FIG. 13, the ratios Hb/Ha, Hc/Ha of the height Ha of the valley in region 420, and the heights Hb or Hc of the peaks adjacent to this region 420, are taken as inspection information, to discriminate the genuineness of the coin 3.

The valley height Ha in the region 420, and the heights Hb and Hc of the peaks adjacent to the region 420, change according to the speed of passage of the coin 3 past the magnetic sensor 2.

Figure 14A:
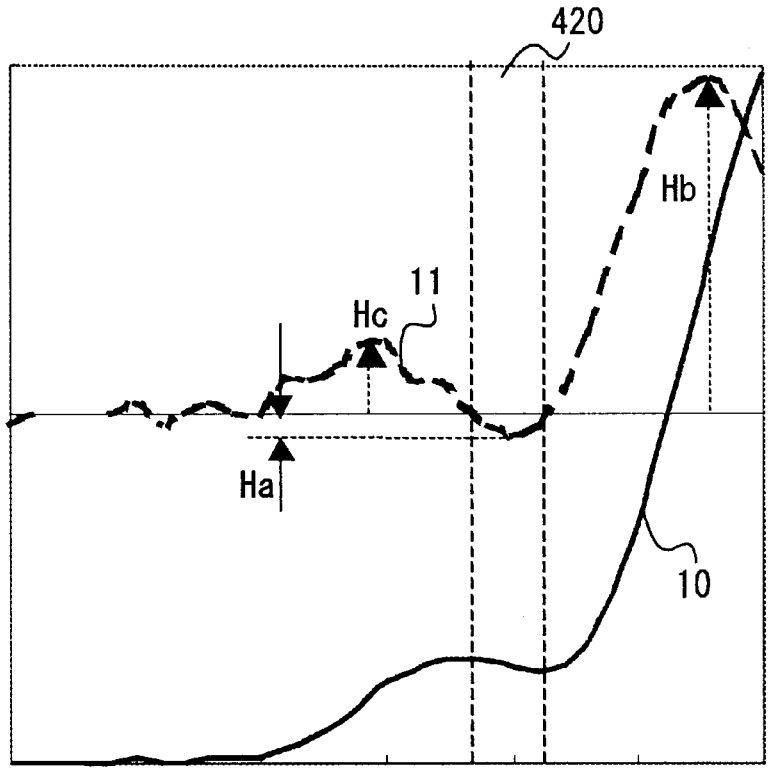
FIGS. 14(*a*) and 14(*b*) are diagrams showing the height Ha of the valley in the region 420 shown in FIG. 13 and the heights Hb and Hc of peaks adjacent to the region 420, corresponding to the speed of passage of the coin 3 past the magnetic sensor 2.
Figure 14B:
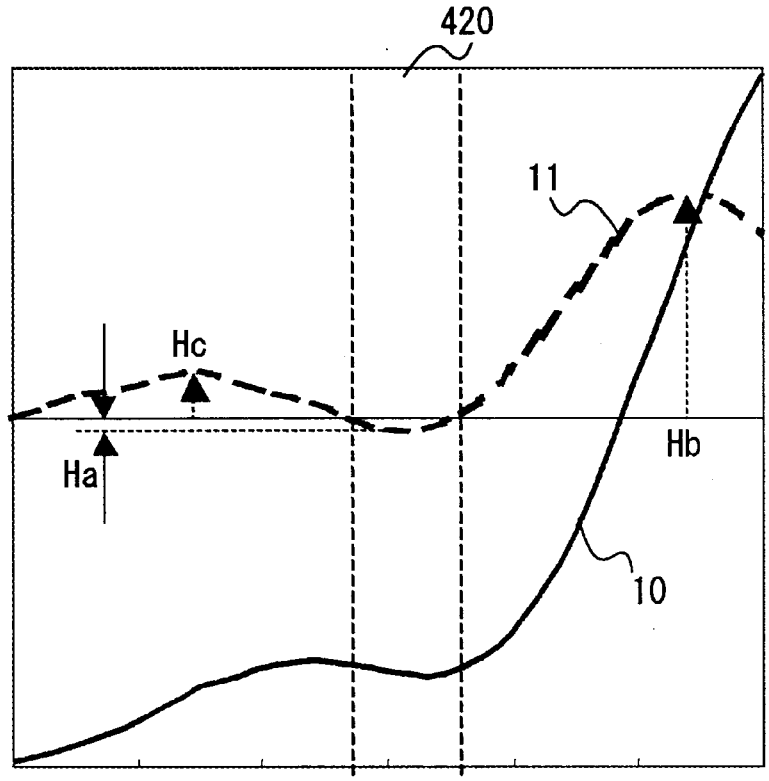

FIG. 14 shows the height Ha of the valley in the region 420 shown in FIG. 13 and the heights Hb and Hc of peaks adjacent to the region 420, corresponding to the speed of passage of the coin 3 past the magnetic sensor 2.

In FIG. 14, FIG. 14(*a*) shows the case in which the speed of passage of the coin 3 past the magnetic sensor 2 is fast, and FIG. 14(*b*) shows the case in which the speed of passage of the coin 3 past the magnetic sensor 2 is slow.

However, as is clear from FIG. 14(*a*) and FIG. 14(*b*), when the speed of passage of the coin 3 past the magnetic sensor 2 is fast, and as a result the height Ha of the valley in the region 420 is high, the heights Hb and Hc of the peaks adjacent to the region 420 also become correspondingly high.

Similarly, when the speed of passage of the coin 3 past the magnetic sensor 2 is slow, and as a result the height Ha of the valley in the region 420 is low, the heights Hb and Hc of the peaks adjacent to the region 420 also become correspondingly low.

Hence as shown in FIG. 13, by using as inspection information the ratios Hb/Ha, Hc/Ha of the height Ha of the valley in the region 420 to the heights Hb or Hc of peaks adjacent to the region 420, the genuineness of the coin 3 can be precisely discriminated, regardless of the speed of passage of the coin 3 past the magnetic sensor 2.

Figure 15:
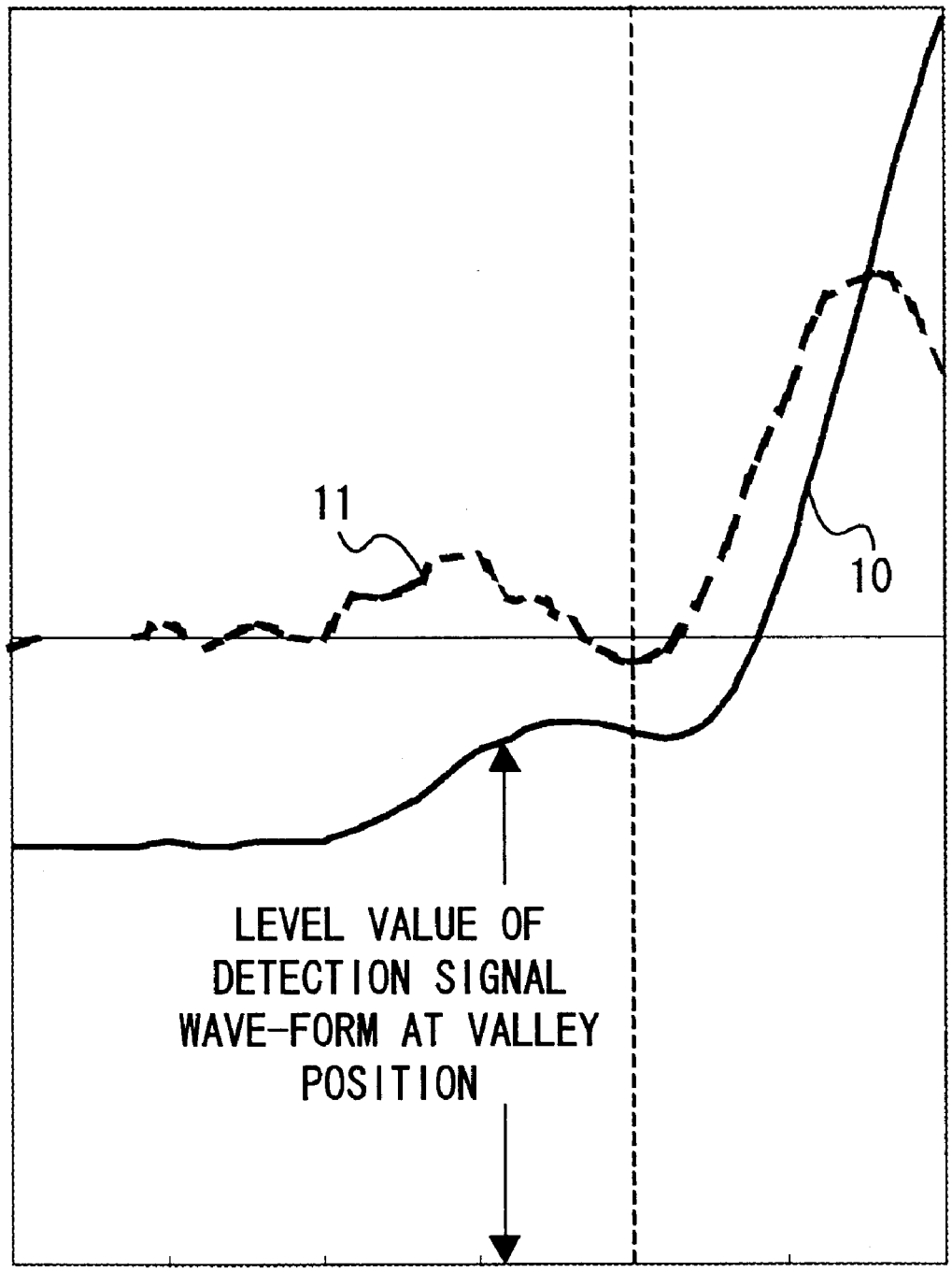
FIG. 15 is a diagram which explains a third method for discriminating the genuineness of the coin 3, focusing on the region 420 corresponding to the second inflection point 42 of the detection signal waveform shown in FIG. 9.

FIG. 15 is a diagram which explains a third method for discriminating the genuineness of a coin 3, focusing on the region 420 corresponding to the second inflection point 42 of the detection signal waveform shown in FIG. 9.

In the third method indicated in FIG. 15, the level value of the detection signal waveform where the differential waveform 11 in the region 420 exhibits a valley is used as inspection information to discriminate the genuineness of the coin 3.

In general, for this type of magnetic sensor, the level value of the detection signal waveform at the point at which the differential value of the differential waveform 11 is minimum has the smallest shift in position along the time-axis (horizontal axis). In contrast, the level value of the detection signal waveform at the point at which the differential value of the differential waveform 11 is maximum exhibits large shifts in position along the time-axis (horizontal axis).

Hence in this third method, by adopting as inspection information the level value of the detection signal waveform where the differential waveform 11 exhibits a valley in the region 420, the genuineness of the coin 3 can be discriminated with high precision, regardless of the speed of passage of the coin 3 past the magnetic sensor 2.

The coin inspection device of this invention is not limited to magnetic sensors, but can similarly be applied to coin inspection devices adopting sensors which output a detection signal which changes with the coin passage, such as optical sensors.

What is claimed is:

1. A coin inspection method, in which a sensor is positioned along a coin pathway through which a coin passes, and inspection of the coin is performed based on a detection signal waveform of the sensor; comprising the steps of:

determining a differential waveform of the detection signal waveform;

extracting first information indicating a peak position of the differential waveform, second information indicating a value of the detection signal waveform at the peak position of the differential waveform, and third information indicating a value of the differential waveform at the peak position of the differential waveform; and inspecting the coin by using the first through third information.

2. The coin inspection method according to claim 1, wherein an output of the sensor is sampled at fixed time intervals and converted from analog to digital values to obtain the detection signal waveform; and differences between adjacent digital values in the detection signal waveform are determined to obtain the differential waveform.

3. The coin inspection method according to claim 1, wherein when a value of the differential waveform at a time t is $\Delta(t)$, a time point at which a difference between the value $\Delta(t)$ and a value $\Delta(t-2)$ of the above differential waveform at a time t−2 which is two sample points previous is zero is extracted as the peak position of the differential waveform.

4. The coin inspection method according to claim 1, wherein when a value of the differential waveform at a time t is $\Delta(t)$, a time point at which a difference between the value $\Delta(t)$ and a value $\Delta(t-N)$ of the differential waveform at a time t−N which is N sample points previous is zero is extracted as the peak position of the differential waveform.

5. A coin inspection method, in which a sensor is positioned along a coin pathway through which a coin passes, and inspection of the coin is performed based on a detection signal waveform of the sensor; comprising the steps of:

determining a differential waveform of the detection signal waveform; and inspecting the coin by using, as inspection information, a characteristic quantity of the differential waveform in a specific region.

6. The coin inspection method according to claim 5, wherein the specific region is a region corresponding to a flange part of the coin.

7. The coin inspection method according to claim 5, wherein an output of the sensor is sampled at fixed time intervals and a result is converted from analog into digital values to obtain the detection signal waveform, and differences between adjacent digital values of the detection signal waveform are determined to obtain the differential waveform.

8. The coin inspection method according to claim 5, wherein the specific region is a region including a zero-cross point of the differential waveform.

9. The coin inspection method according to claim 8, wherein the characteristic quantity is a level difference between a height of valley part in the detection signal waveform in the specific region and a height of a peak part adjacent to the valley part in the detection signal waveform.

10. The coin inspection method according to claim 5, wherein the specific region includes a valley part of the differential waveform, and the characteristic quantity is a ratio of a height of valley part in the differential waveform to a height of a peak part adjacent to the valley part of the differential waveform.

11. The coin inspection method according to claim 5, wherein the specific region includes a valley part of the differential waveform, and the characteristic quantity is a value of the detection signal waveform corresponding to the valley part of the differential waveform.

12. A coin inspection device, in which a sensor is positioned along a coin pathway through which a coin passes and the coin is inspected based on a detection signal waveform of the sensor, comprising:

differential processing means for determining a differential waveform of the detection signal waveform;

information extraction means for extracting first information indicating a peak position of the differential waveform obtained by the differential processing means, second information indicating a value of the detection signal waveform at the peak position of the differential waveform, and third information indicating a value of the differential waveform at the peak position of the differential waveform; and, inspection means for inspecting the coin based on the first through third information.

13. The coin inspection device according to claim 12, wherein the differential processing means comprises:

analog-digital conversion means which samples the detection signal waveform of the sensor at fixed time intervals and converts a result from analog to digital values in order to determine detection data corresponding to the detection signal waveform; and differential data calculation means to determine differential data by calculating the differences between adjacent digital values of the detection data determined by the analog-digital conversion means, wherein the information extraction means extracts the first information indicating a peak position of the differential data determined by the differential data calculation means, the second information indicating a value of the detection data at the peak position, and the third information indicating a value of the differential data at the peak position; and the inspection means inspects the coin by using the first through third information extracted by the information extraction means.

14. The coin inspection device according to claim 13, wherein, when a value of the differential waveform at a time t is $\Delta(t)$, the information extraction means extracts, as the peak position of the differential waveform, a time point at which a difference between the value $\Delta(t)$ and a value $\Delta(t-2)$ of the differential waveform at a time t−2 which is two sample points previous is zero.

15. The coin inspection device according to claim 13, wherein, when a value of the differential waveform at a time t is $\Delta(t)$, the information extraction means extracts, as the peak position of the differential waveform, a time point at which a difference between the value $\Delta(t)$ and a value $\Delta(t-N)$ of the differential waveform at a time $t-N$ which is N sample points previous is zero.

16. A coin inspection device in which a sensor is positioned along a coin pathway through which a coin passes, and the coin is inspected based on a detection signal waveform of the sensor, comprising:

differential processing means for determining a differential waveform of the detection signal waveform; and coin inspection means for inspecting the coin, using, as inspection information, a characteristic quantity in a specific region of the differential waveform determined by the differential processing means.

17. The coin inspection device according to claim 16, wherein the specific region is a region corresponding to a flange part of the coin.

18. The coin inspection device according to claim 16, wherein the differential processing means comprises:

analog-digital conversion means which samples an output of the sensor at fixed time intervals and performs analog-digital conversion to obtain the detection signal waveform; and differential waveform calculation means which determines the differential waveform by calculating the differences between adjacent digital values in the detection signal waveform obtained by the analog-digital conversion means.

19. The coin inspection device according to claim 16, wherein the specific region is a region containing a zero-cross point of the differential waveform.

20. The coin inspection device according to claim 19, wherein the coin inspection means inspects the coin, using, as the inspection information, a level difference between a height of a valley part of the detection signal waveform corresponding to the specific region of the differential waveform, and a peak part adjacent to the valley part of the detection signal waveform.

21. The coin inspection device according to claim 16, wherein the specific region is a region including a valley part of the differential waveform, and the coin inspection means inspects the coin, using, as the inspection information, a ratio of a height of the valley part of the differential waveform to a height of a peak part of the differential waveform adjacent to the valley part.

22. The coin inspection device according to claim 16, wherein the specific region is a region including a valley part of the differential waveform, and the coin inspection means inspects the coin, using, as the inspection information, a value of the detection signal waveform corresponding to the valley part of the differential waveform.

* * * * *